United States Patent [19]

Bell

[11] Patent Number: 4,533,104

[45] Date of Patent: Aug. 6, 1985

[54] INFINITELY ADJUSTABLE SUPPORT SYSTEM

[75] Inventor: George M. Bell, Revere, Mass.

[73] Assignee: Hillel Stavis, Cambridge, Mass.

[21] Appl. No.: 533,359

[22] Filed: Sep. 19, 1983

[51] Int. Cl.[3] ..... A47G 29/02

[52] U.S. Cl. ..... 248/245; 108/108

[58] Field of Search ..... 248/235, 243, 245, 246, 248/297.2; 211/187; 108/106, 107, 108, 110, 192

[56] References Cited

U.S. PATENT DOCUMENTS

| | | | |
|---|---|---|---|
| 618,510 | 1/1899 | Kail | 248/245 |
| 1,053,996 | 2/1913 | Isbell | 108/107 |
| 3,071,350 | 1/1963 | Opie | 248/297.2 X |
| 3,111,723 | 11/1963 | Bates | 248/297.2 X |
| 3,765,344 | 10/1973 | Ferdinand | 108/108 |
| 3,868,081 | 2/1975 | Morgan | 248/245 |

FOREIGN PATENT DOCUMENTS

| | | | |
|---|---|---|---|
| 1264653 | 5/1961 | France | 248/246 |
| 781480 | 8/1957 | United Kingdom | 248/243 |
| 951322 | 3/1964 | United Kingdom | 248/245 |
| 1345700 | 1/1974 | United Kingdom | 248/246 |

*Primary Examiner*—J. Franklin Foss

*Attorney, Agent, or Firm*—Jerry Cohen; William E. Noonan; M. Lawrence Oliverio

[57] ABSTRACT

An Article support system comprising: a mechanism defining at least one structural support elongated channel; a mechanism defining at least one support bracket with a pivotable end insertable into the channel; a mechanism defining a latch member for latching and unlatching the bracket into and out of locking frictional engagement with the channel; a mechanism for pivotably mounting the latch from the bracket in a longitudinal and latitudinal direction; a mechanism for locking the latch to the bracket in a stressed arrangement in the latching position; a fulcrum mechanism for transmitting a first latch stress to the bracket end in the latching position and an opposing latch stress distributed among the fulcrum, and discrete areas of the latch and the bracket, the mechanism constructed and arranged for applying primary frictional force between a bracket end inserted in the channel and an interior surface of the channel in the locked position and a secondary frictional force between the bracket and latch in the locked position as the latch and bracket go through relative pivotal movement about the pivot mechanism and relative lateral movement, the forces being maintained by the mechanism for locking.

10 Claims, 20 Drawing Figures

INFINITELY ADJUSTABLE SUPPORT SYSTEM

BACKGROUND OF THE INVENTION

This invention relates to infinitely adjustable cantilever support systems and, in particular, to such systems utilized for article support, e.g. shelf support.

In typical prior art cantilever support systems, it is of primary importance that the system have structural strength and also that its support component be safe from accidental slippage or disengagement from the system's other components.

It is also very desirable that said support systems be adjustable in the most efficient ways possible and without abrading or marring the system's visible surfaces. Previous systems offered for sale and/or described in patents and other publications have attempted to fulfill these requirements and have been and are inadequate.

A common type of prior art adjustable support system consists of an apertued vertical support member to which a horizontal support member is attached by means of hook-line protrusions on the bracket. These systems, such as the one described in U.S. Pat. No. 3,703,727, Engel et al, are limited in that they may be adjusted by incremental distances only and are also very often diffucult to engage or disengage.

To incorporate the advantage of being infinitely adjustable, cantilevered structural support systems have been developed which employ the use of well known principles, involving cantilevering forces, to generate sufficient friction to balance downwared forces created by article loaded horizontal support bracket. This friction, created by the horizontal support being rotated downwared under load, will, henceforth for simplicity's sake, be termed the primary frictional force.

In the design of such cantilevered support systems, it has also been found necessary to be able to generate a separate and lesser frictional force to overcome loads on the horizontal support bracket that, due to the distribution of said loads, does not have adequate leverage to create enough primary frictional force to overcome the reducing factor created by the co-efficient of friction of the materials used in the spports. Reliance on such expedients as a load placed very close to the connection point of the structural support components or the dead weight of the horizontal bracket is displaced in that such loads require a secondary frictional force to be generated in order to prevent slippage and/or disengagement of the structural system's components.

Examples of such cantilevered structural support systems are those described in U.S. Pat. No. 4,098,482 to Hamblin and U.S. Pat. No. 3,865,337 to Towfigh, et al. These systems incorporate a horizontal support member that is rotated downward to interlock with the vertical support and to generate the necessary frictional forces. This is done at the cost of safety, as any accidental upwardly directed force on the support bracket will cause it to slip in its vertical support member. Another deficiency to be found is that, in order to engage or remove the horizontal support brackets, those brackets already in place must be moved or removed. Should the vertical support members be verylong, it is very awkward to engage or remove the horizontal brackets.

Support systems such as the design-type described in U.S. Pat. No. 3,848,844 to Barnet use a locking mechanism, such as a cam or a bolt, to generate adequate secondary frictional forces. The disadvantage inherent in this design-type is that, in manipulating the locking mechanism, it is necessary to use a tool, such as a wrench, and that in manipulating said mechanism, the visible surfaces of the system are indented or marred. It can also be seen that these systems retain the same problems aforementioned regarding quick and easy removal of the horizontal brackets.

Another class of article support system, exemplified in disclosures such as U.S. Pat. No. 3,664,627 to Sykes and U.S. Pat. No. 4,223,863 to Berman, includes systems designed so that the horizontal support brackets may be engaged without having to slide the brackets into the end of the vertical support as in the above classes. However, due to the fact that the brackets still must be rotated for adjustment, any brackets in place above their arc of rotation must be moved. Also, again, the problem of accidental disengagement results in an unsafe support system.

There are structural support systems, such as U.S. Pat. No. 3,203,375 to Shroeder, that are designed so the horizontal support may be directly engaged into the vertical supporting member without the need to rotate the bracket. It can be seen, though, that in order to generate adequate secondary frictional forces excessive hand pressure is required to manipulate the bracket. As stated before, in citing other patents, accidental disengagement is a hazardous factor of the design.

Many systems, some of which have been previously mentioned, generate required secondary frictional forces by the rotational manipulation of the horizontal support bracket. This type of engagement also has the effect of compounding stress on the connecting joint of the structural components and of unduly indenting or marring the track. Therefore, systems using such engagement types must rely more on the frictional forces generated by the primary frictional force and to accomplish this the depth of the horizontal brackets connecting base is kept relatively shallow. However, by decreasing the depth of base, greater stress is placed on the connecting joint of the structural components. This problem is especially acute in these structural support systems aforementioned where horizontal brackets use only a single protuberance at their connecting base to engage the vertical structural support. To compensate for this deficiency either thicker or stronger materials must be incorporated in the structure, resulting in a bulkier support system of greater cost than necessary.

It is, therefore, an object of this invention to provide an infinitely adjustable structural support system which provides a structurally strong and frictionally tight joint between structural components while enabling easy and rapid assembly of said components.

It is a further object of this invention to provide a strong and infinitely adjustable support system whose main components cannot be accidentally disengaged.

It is a further object of this invention to provide an infinitely adjustable support system whose integral components do not mar or blemish the visible surfaces of said system.

It is a further object of this invention to provide an infinitely adjustable support system having the aforementioned advantages, using the minimum of materials and using the simplest and most efficient manufacturing techniques.

SUMMARY OF THE INVENTION

This invention features an infinitely adjustable article support system which includes as its main components:

(a) a structural support elongated channel into which is engaged and locked (b) a cantilevered horizontal support bracket, to lock and frictionally engage said bracket to said channel a latch component (c) is pivotably or slidably attached to said bracket near its support end by a mounting element (d). The opposing end of the latch outside the point of attachment, is provided with a means (e) to lock the latch to the bracket. The latch is also provided with a fulcrum means (f) near its pivotable attachment point, so that, when manipulated and engaged, said latch acts as a lever to generate frictional forces between the bracket/latch assembly and the support channel. The bracket supporting channel may take the form of a standard attached vertically to a wall or may be configurated as a vertical post and/or bar to form, in conjunction with other like or unlike members, a free-standing unit.

In one preferred embodiment, several parallel and spaced structural support channels are vertically arranged and attached to a wall so that they will, in conjunction with horizontal support brackets locked by the latches, support shelves.

The walls of said channel, in cross section, are formed in such a way that the interior space defined by them forms an elongated groove. This groove is of generally triangular or v-shape in cross section, the apex of which is directed toward the face of the said channel that receives the horizontal support bracket. This particular V cross-sectional configuration allows the direct and easy insertion of the horizontal support bracket into the channel groove. Into said channel groove is received and engaged a horizontal support bracket of which the channel engaging end is formed at an angle greater than 90° to the main body of the bracket so as to create a flange that is dimensionally compatible and receivable into one slot of the cross-sectionally V-shaped channel groove. Though the support bracket may be essentially otherwise unangled and run straight perpendicularly from the channel face, in this embodiment added frictional engagement is generated by forming two 45° bends near the bracket-connecting base giving the bracket in plan an approximate Z-shape. Such a configuration increases the leverage effect of the bracket by causing the bracket to cantilever in a plane of rotation angled to the main rotational plane of said bracket. This added leverage generates secondary frictional forces without stressing the connecting point in the same direction as the primary cantilevering forces, thus not pre-stressing the structural joint in a negative fashion.

To lock the horizontal support bracket into the vertical support channel and also to provide secondary frictional forces, a latch is pivotably attached to said bracket near its connecting base end. The pivot may take the form of a standing rivet with enough clearance to allow the latch to be moved laterally about a fulcrum means. The end of the latch, opposite the channel-engaging end, is made sufficiently long so that the latch acts as a lever, primarily when it is moved laterally, toward the bracket sidewall, about the fulcrum means. The fulcrum may take the form of an angular bend of the latch. When the latch is manipulated, it is rotated about the pivot, causing it to slide into the channel groove. The latch is then pressed laterally, about the fulcrum means, toward the bracket sidewall. To enable the latch to retain the pressure so generated, the manipulated, it is rotated about the pivot, causing it to slide into the channel groove. The latch is then pressed laterally, about the fulcrum means, toward the bracket sidewall. To enable the latch to retain the pressure so generated, the manipulated end of the latch may be formed into a hook that is slid over the edge of the bracket and into a notch therein.

Protruding at a horizontal angle from the base of the bracket is a flange formed from the bracket body. The flange is so shaped that it forms a retaining notch for the latch when it is in the open position. This retaining flange prevents lateral movement of the latch thus keeping it aligned with the slot in the vertical support. When the latch is pivoted to a closed position, it swings free of the retaining flange wherein said latch can then be laterally moved to engage and lock the bracket in the vertical support channel.

The invention provides improved means of quick and easy assembly of the structural components while providing a superior frictional engagement in a way that uses the simplest and most efficient means of manufacture and material. It should be noted that not only does this invention provide an improved infinitely adjustable structural support system, as shown by its various embodiments, such as for shelves, but may have other successful applications through other embodiments which are in the scope and spirit of this invention. For example, the invention can be applied to floor or ceiling tracks rather than wall tracks. The linear track support component can be straight or curved, continuous or discontinuous.

Other objects, features and advantages of the invention will be apparent from the following detailed description of preferred embodiments with reference therein to the accompanying drawing in which:

DETAILED DESCRIPTION OF PREFERRED EMBODIMENTS

Figure 2:
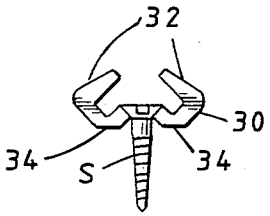
FIG. 2 is a cross-sectional view of the vertical support channel shown in FIG 1.
Figure 3:
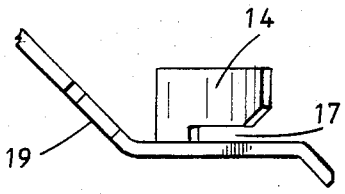
FIG. 3 is a plan view showing the end portion of the horizontal support bracket that engages the vertical support channel in the FIG. 1 embodiment.

FIGS. 1–7 show a first embodiment of the support system of the invention in which repeating elements comprise a bracket member 10, a latch member 20 and a channel 30. A series of the brackets 10 are contained in the channel 30. Associated with each bracket is a latch member 20 loosely mounted thereto by a pivotal member 12, such as a standing rivet (a rivet secured to the bracket 10 by rivet heading or welding and having a stem 13) passing through an oversize—in relation to the stem—hole 22 in latch 20 and terminating in a head 13 which keeps latch member 20 from sliding off the stem when the latch and bracket are not engaged in support.

The bracket 10 has a running support section 15 and a lock flange 14 as its essential elements. The running section 16 can be straight as in FIGS. 10–17 or of Z-form (together with flange 18 as in FIGS. 1–7 and 18–20) or of a variety of hybrid forms (e.g. several adjacent Z-forms, a sine-wave over its running length, an H-assembly, and non-planar forms, e.g. a rod or cylinder).

Each latch 20 has a pushing flange 24, a main stem 26 and a lock end 28.

Figure 4:
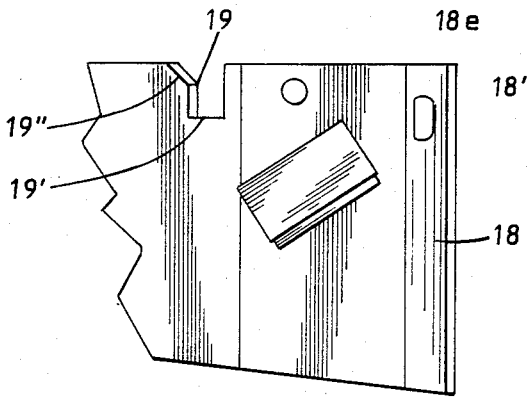
FIG. 4 shows an elevation view of the end of the horizontal support bracket from the side that is not revealed in FIG. 1.
Figure 5:
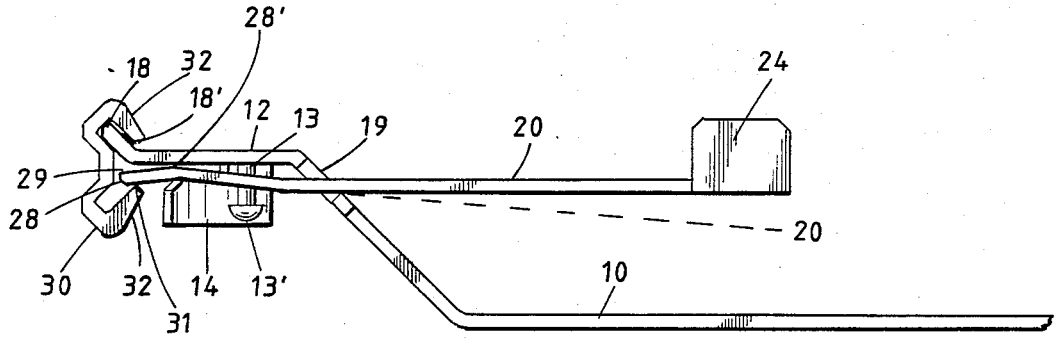
FIG. 5 is a plan view of the vertical support channel of FIG. 1 with the horizontal support bracket engaged and locked.
Figure 6:
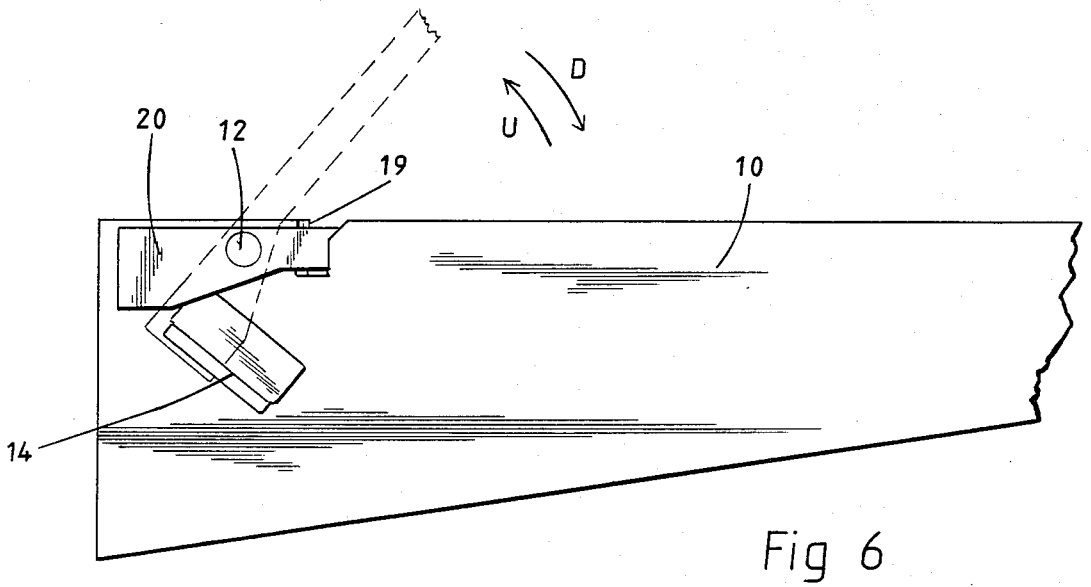
FIG. 6 is an elevation view of the horizontal support bracket shown in FIG. 1.

The bracket 10 has a notch 19 with a latch retaining section 19 and a lever entrance/exit ramp 19 in the embodiment of FIGS. 1–7. The latch member 20 seats in the notch as shown best in FIGS. 1, 5, and 6 (solid lines) when locking. The unlocked position with the latch clearing the notch is shown in FIGS. 6 (chain lines) and 7.

A bent-out section of bracket 10 provides a similar notch 17 (i.e. similar to notch 19) accommodating the latch 20 in the unlatched position.

In the embodiment of FIGS. 10–13 a notch 192 without a ramp is provided in bracket 101, embodiment of FIGS. 14–17, a notch 27 is provided and a flange 26′ engages hole 26′ in the latch in the latched (load supporting) configuration.

The channel 30 used in the FIGS. 1–7 embodiment has a truncated Vee-form defined by thickened legs 32 and a base 34 with holes 34 for accommodating screws S which secure the channel 30 to a wall. The channel may also be provided as a free standing pole, on ceilings or floors and on the surfaces of tables, carts and the like for various support applications.

Figure 9:
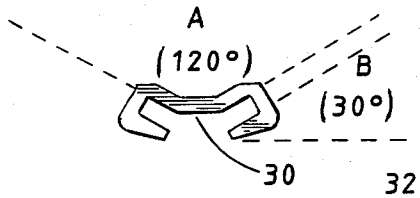
FIG. 9 shows a cross-sectional view of a further embodiment, the vertical support channel of which has the slots forming a dihedral angle of 120° to each other.

The flange 18 of the bracket 10 has dimples 18 (provided e.g. by punched indentations, weld heads or rivet heads) to rub against the inner surface of a leg 32 (see FIGS. 4, 5 and 7) when latching. Important angles A and B of construction of the channel, preferrably 120° and 30° respectively and as shown in FIG. 9, A may be varied from 100°–140° and B from 20°–45°.

Figure 8:
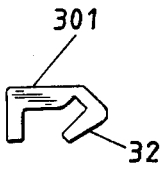
FIG. 8 shows a cross-sectional view of a channel element of a second embodiment of the invention featuring an asymmetrical embodiment of the vertical support channel.
Figure 10:
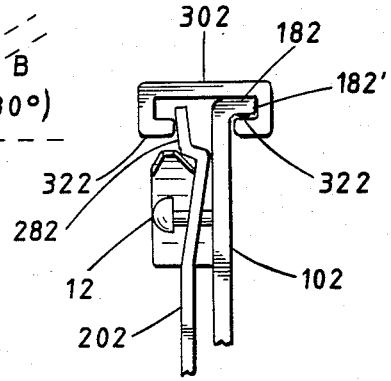
FIG. 10 shows a plan view of an embodiment with a vertical support channel that has a T-cross-sectional shape (also shown is a portion of the horizontal support bracket engaged into the channel)
Figure 11:
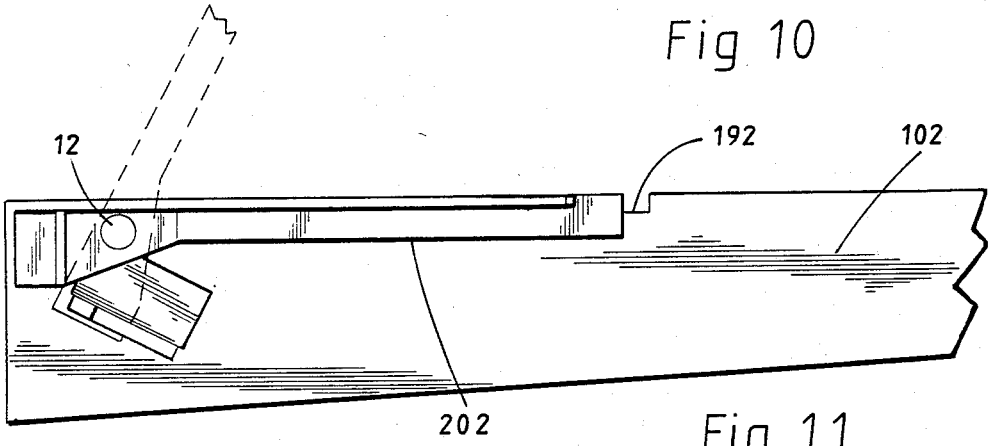
FIG. 11 shows an elevation view of the horizontal support bracket of FIG. 10.
Figure 12:
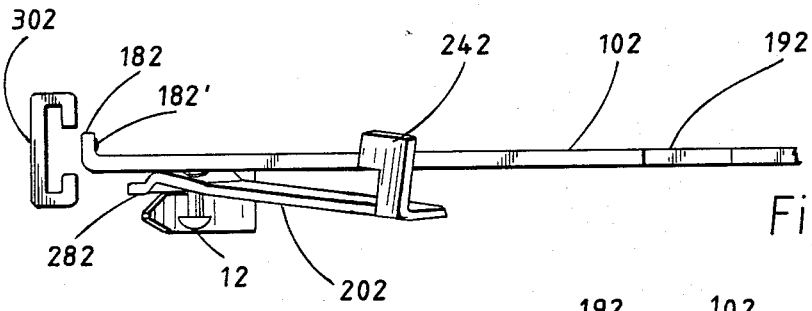
FIG. 12 is a plan view of the horizontal support bracket of FIG. 10, in the unlocked position and disengaged from the vertical support channel.
Figure 13:
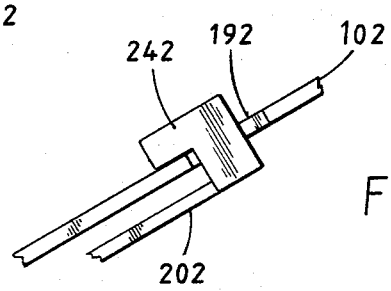
FIG. 13 is a plan view showing the end of the latch fitted in the bracket of the FIGS. 10–12 embodiment.
Figure 14:
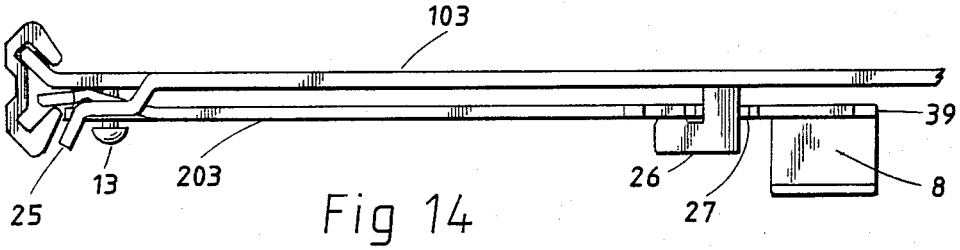
FIG. 14 is a plan view of another embodiment of the invention.
Figure 15:
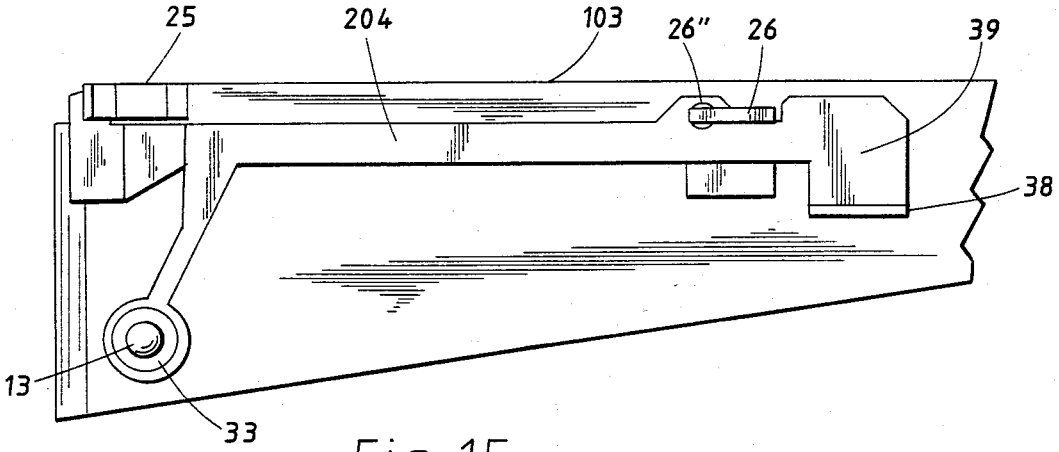
FIG. 15 shows an elevation view of the horizontal support bracket shown in FIG. 14.
Figure 16:
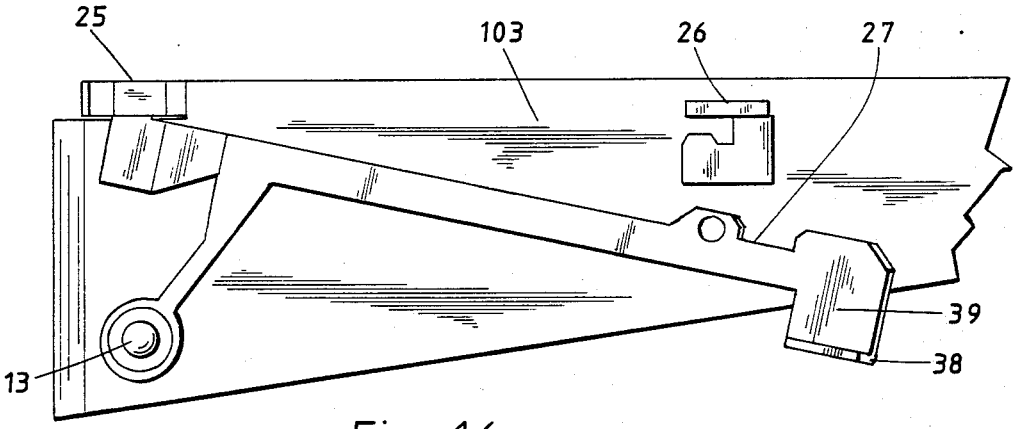
FIG. 16 shows an elevation of the horizontal bracket shown in FIG. 15 with the latch in the unlocked position.
Figure 17:
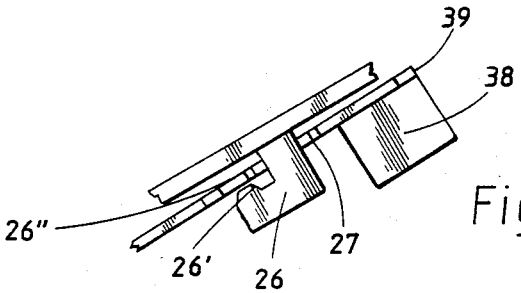
FIG. 17 shows the end detail of the latch in plan and a position of the horizontal bracket.

FIGS. 8 and 10 show variant forms of the channel. Item 301 of FIG. 8 is a half-Vee channel with a single leg 32, Item 302 of FIG. 10 is a Tee-form channel with legs 322. FIGS. 10–17 shows a further embodiment of the invention in which the latch 202 has the latching notch, bracket 102 has a straight form except for a gripping stem 182 turned out at a right angle to the bracket and having dimples 182 to engage a leg 322 of channel 302.

OPERATIONS

The arrows U and D in FIG. 6 show up and down direction of rotation of latch 20 for unlocking and locking.

Figure 1:
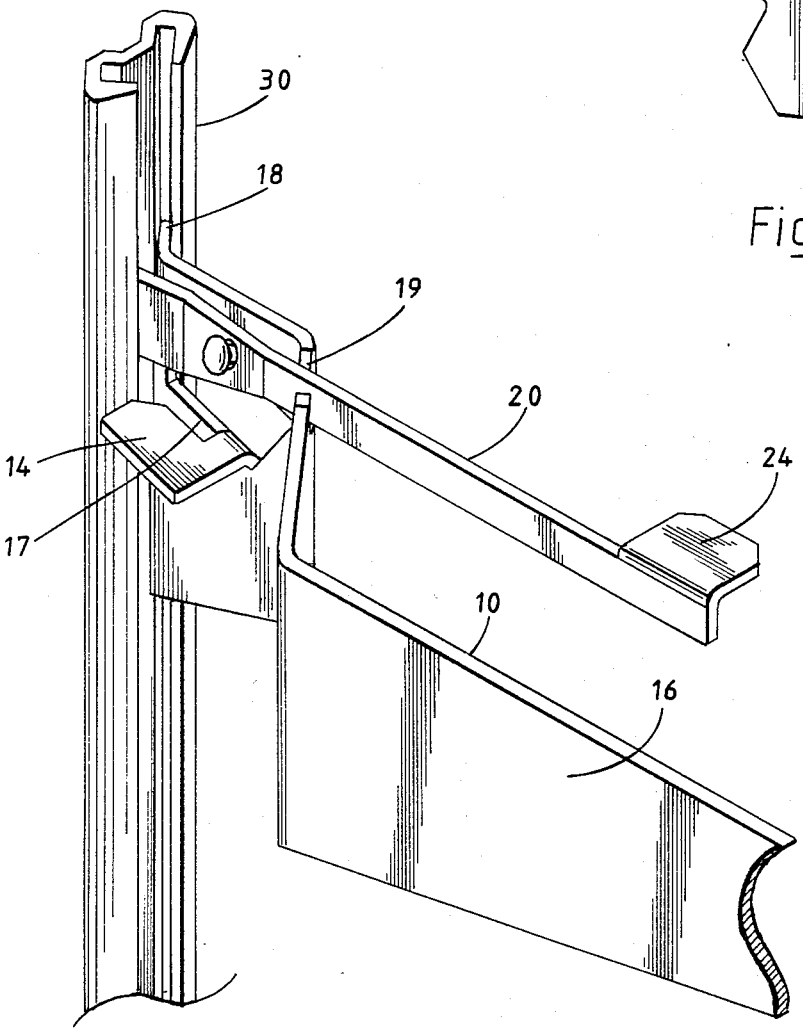
FIG. 1 is a perspective view of vertical support channel into which is engaged a horizontal support bracket in accordance with a first embodiment of the invention.
Figure 7:
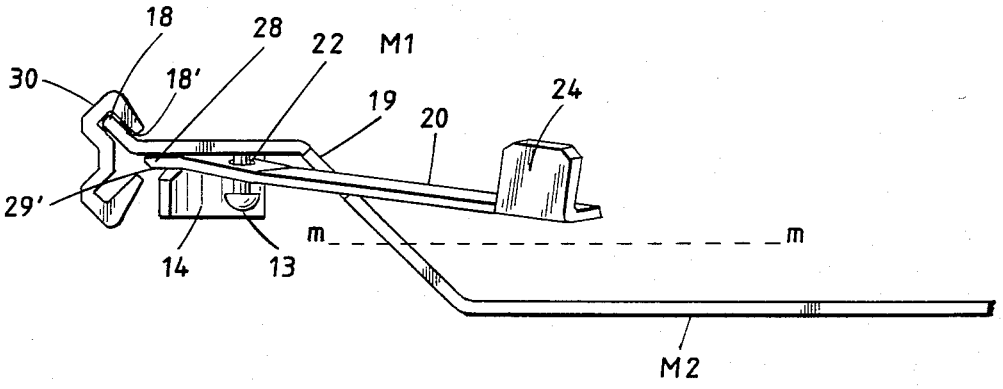
FIG. 7 is a plan view of the vertical support channel of FIG. 1 and the horizontal support bracket with the latch in an upward, unlocked position.

A channel 30 is, e.g., wall mounted via screws S (FIGS. 1–2). A bracket latch assembly with the latch in up position is ready for insertion. The flange 18 of the bracket is inserted in a slot of the Vee-form channel as shown in FIG. 7. This insertion can be made at any desired height; the positioning of the bracket relative to the channel length is infinitely variable. Once a position is selected and the insertion is made, then the user pushes on flange 24 of latch 20 to rotate the latch about rivet 12. As the latch pushes into slot 19, it slides down ramp 19 into the squared off notch portion 19 (FIG. 4). At the same time, latch 20 is so rotated, it is laterally displaced from the position of 20 (dashed line in FIG. 5) to the position shown for 20 in solid lines in FIG. 5. When latch 20 is laterally displaced (and locked by notch 19 in the laterally displaced position) the pressure aplied at 31 to bracket 20 stresses flange 18 to bear against a thickened (stiff) leg 32 of channel 30 and prevent the bracket/latch assembly from sliding in channel 30, even when the assembly is under heavy loading. Indeed, the loading (e.g. a bookshelf on bracket 10, also resting on the latch member) helps hold the assembly in locked position. Forces are applied perpendicular to the plane of rotation at 19, 28′, 31 and at the 18/32 interface.

The force of 18 is applied in a dimple 18′ and this prevents the upper edge 18 of the bracket from carrying stress allowing for the material in flange 18 to carry stress in the most efficient way.

In FIG. 7 the chain-line M—M illustrates a median plane of bracket 16. The plane is parallel to and in between the planar sections M2 and M2 of bracket 10 and tab 18 is bent at an angle of 20–50 degrees, preferrably 35–45 degrees to the M—M plant. The primary frictional force is applied by the supported load appears at 18′ and 31 across planes which intersect the median plane. The secondary force applied by latching (before loading a supported item) appears principally at 19 across a plane essentially parallel to the median plane. Reaction for us related to the force applied at 19 appear at 18′, 28′ and 31. The offset of plan M2 from M1 increases the torque applied by a shelf and its loading resting on M2. This increased torque enhances locking at the 28/18 interface.

The structual arrangement allows for high tolerance of dimensional variation in extrusion of channel 30 and in manufacture of the bracket 10 (and IB flange 18) and latch 20 (and its flange 28), as well as a dimensionally insensitive pivotal mounting at rivet 12.

A space 29 is created (as shown in FIG. 5) in latching and exchanged for a space of equal span 29′ in unlatching (FIG. 7) to allow for dimensional variation in manufacture of parts 10, 20, 30 and components thereof.

The same operational considerations described above for the operations of the embodiment of FIGS. 1–7 apply similarly for the embodiments of FIGS. 8–20, with limited exceptions. In the embodiment of FIGS. 14–17, the latch 203 swings from under bracket 103 and the latch top does not come flush with the bracket top in latching.

Figure 18:
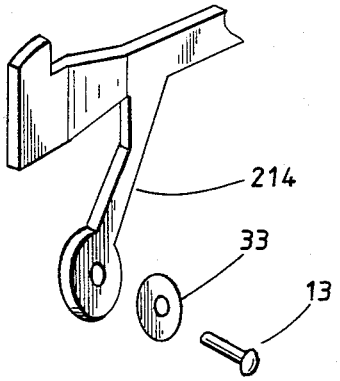
FIG. 18 is a perspective exploded view of the latch shown in FIGS. 14, 15, 16, 17, and the nylon washer #33 and the standing rivet.
Figure 19:
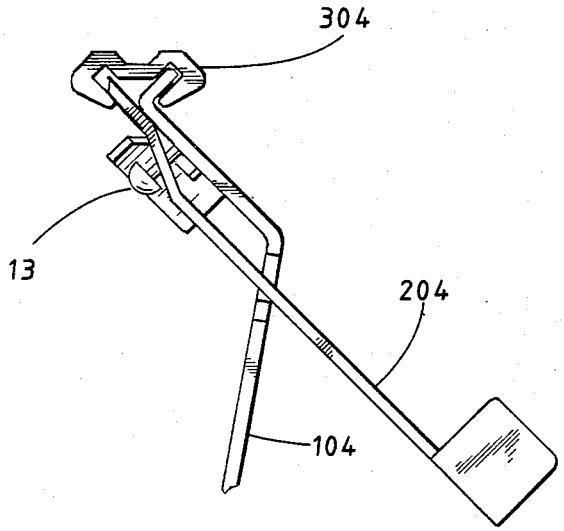
FIG. 19 is a plan view of a variant of FIG. 1, to illustrate the varied possibilities of altering the running length course of the bracket; and of the FIG. 1 embodiment and other embodiments.
Figure 20:
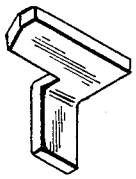
FIG. 20 is a retaining flange, shown in other embodiments perspective, that is made as a separate piece and then attached spot weld or rivet, epoxy-glue, etc., to a horizontal bracket.

FIGS. 18–20 show a further embodiment with 104, latch 204 and channel 304. The bracket and latch are held together by a standing rivet 13 passing through an oversize hole in an extension arm 214 latch 204.

It is evident that those skilled in the art, once given the benefit of the foregoing disclosure, may now make numerous other uses and modifications of, and departures from, the specific embodiments described herein without departing from the inventive concepts. Consequently, the invention is to be construed as embracing each and every novel feature and novel combination of features present in, or possess by, the apparatus and techniques herein disclosed and limited solely by the spirit and scope of the appended claims.

What is claimed is:

1. Article support system comprising:

(a) means defining at least one structural support elongated channel;

(b) means defining at least one support bracket with a pivotable end insertable into said channel;

(c) means defining a latch member for latching and unlatching the bracket into and out of locking frictional engagement with the channel;

(d) means for pivotably mounting the latch from the bracket in a longitudinal and latitudinal direction;

(e) means for locking the latch to the bracket in a stressed arrangement in the latching position;

(f) fulcrum means for transmitting a first latch stress to the bracket end in the latching position and an opposing latch stress distributed among the fulcrum, and discrete areas of the latch and the bracket, the said means being constructed and arranged for applying primary frictional force between a bracket end inserted in the channel and an interior surface of the channel in the locked position and a secondary frictional force between the bracket and latch in the locked position as the latch and bracket go through relative pivotal movement about said pivot means and relative lateral movement, said forces being maintained by said means for locking.

2. Article support means in accordance with claim 1 wherein said at least one of said bracket and latch has an angled form establishing a main direction of cantilever support in a first median plane and an intersecting second plane for application of the said primary frictional force.

3. Article support means in accordance with claim 2 constructed and arranged to provide said secondary frictional force in a plane parallel to or coincident with said first median plane.

4. Article support means in accordance with claim 2 constructed and arranged to provide said secondary frictional force in a plane intersecting said first plane.

5. Article support means in accordance with claim 1 wherein said channel has a mouth for receiving a frictional engaging end of the bracket by direct insertion perpendicular to the longitudinal direction of the channel at any point along a channel length, said channel further having a recess for accommodating lateral movement of said end and sufficient opening to receive an end of the latch pivoting into and through the channel.

6. Article support means in accordance with claim 5 wherein said channel defines at least one-half of a Vee-form opening with its apex initially receiving the bracket.

7. Article support means in accordance with claim 5 wherein said channel defines at least one-half of a Tee-form bracket.

8. Article support means in accordance with claim 1 wherein said locking means comprise a holding portion of the bracket receiving a latch portion.

9. Article support means in accordance with claim 1 wherein said locking means comprise a holding portion of the latch receiving a bracket portion.

10. Article support means in accordance with claim 1 further comprising slot means for guiding the latch member into the channel and holding the latch member when disengaged from the channel.

* * * * *